US008132956B2

(12) United States Patent
Hsu

(10) Patent No.: US 8,132,956 B2
(45) Date of Patent: Mar. 13, 2012

(54) LAMP STRUCTURE IMPROVEMENT IN THE TWO-LAMPS TYPED DECORATION LAMP STRING

(76) Inventor: Fu-Hsien Hsu, Hsinchu (TW)

( * ) Notice: Subject to any disclaimer, the term of this patent is extended or adjusted under 35 U.S.C. 154(b) by 290 days.

(21) Appl. No.: 12/543,518

(22) Filed: Aug. 19, 2009

(65) Prior Publication Data

US 2011/0043090 A1 Feb. 24, 2011

(51) Int. Cl.
*H01R 33/00* (2006.01)

(52) U.S. Cl. ..... 362/653; 362/652; 362/654; 362/657; 362/658; 362/659

(58) Field of Classification Search ..... 362/640, 362/645, 652, 653, 654, 657, 658, 659
See application file for complete search history.

(56) References Cited

U.S. PATENT DOCUMENTS

| | | | | |
|---|---|---|---|---|
| 7,025,490 | B1 * | 4/2006 | Tseng | 362/654 |
| 7,427,784 | B2 * | 9/2008 | Liu et al. | 257/99 |
| 7,575,362 | B1 * | 8/2009 | Hsu | 362/654 |
| 2007/0138496 | A1 * | 6/2007 | Zhao et al. | 257/98 |
| 2008/0124984 | A1 * | 5/2008 | Li | 439/699.2 |
| 2011/0074300 | A1 * | 3/2011 | Hsu | 315/185 S |

* cited by examiner

*Primary Examiner* — Stephen F Husar
*Assistant Examiner* — James Cranson, Jr.
(74) *Attorney, Agent, or Firm* — Leong C. Lei

(57) ABSTRACT

The present invention is to provide a lamp structure improvement in the two-lamps typed decoration lamp string. Each lamp body of the said lamp string is composed of a single soft head, a single soft core and a LED single body of the ordinary half-shaped type separately package-covered with a single lighting crystalline grain then leaned against each other to form a lamp of ordinary shape-and-sized single-piece LED such that the mutually assembled and formed single-piece-shaped LED can have two lighting crystalline grains and form a two-lamps typed lamp body. It thus can effectively lower the manufacturing cost of lamp body in the two-lamps typed decoration lamp string.

3 Claims, 4 Drawing Sheets

LAMP STRUCTURE IMPROVEMENT IN THE TWO-LAMPS TYPED DECORATION LAMP STRING

BACKGROUND OF THE INVENTION

The present invention is mainly aimed at a lamp structure improvement in the two-lamps typed decoration lamp string. The known two-lamps typed decoration lamp string ordinarily seen roughly has three kinds of shapes wherein there is one kind shown as in FIG. 1. The lamp body 10 of said two-lamps typed decoration lamp string combines two single lamp bodies composed of a soft head 11, a soft core 12, and a lamp 13 and sleeves by a sleeve ring 14. Another kind of two-lamps typed decoration lamp string is shown as FIG. 2, which links two soft heads 11 as a body in advance then cooperates with two soft cores 12 and two lamps 13, and is assembled as a lamp body 10 of two lamps. The aforementioned two kinds of two-lamps typed lamp bodies 10 are both composed of two soft heads 11, two soft cores 12, and two lamps 13; its cost should be higher relatively. There is further one kind of two-lamps typed lamp body as shown in FIG. 3, which mainly adopts a lamp body 10 composed of a single soft head 11, a single soft core 12, and a single lamp 13. Due to two lamps 13 needs to be accommodated on the soft core 12 simultaneously, its volume should be larger. Relatively, the volume of soft head 11 required to accommodate the soft core 12 also should be much larger. Thus, its manufacturing cost is also higher. Furthermore, in ordinary LED (light emitting diode) lamps, there are also set with multiple lighting crystalline grains simultaneously in the packaging cover body. But, owing to the problems of technical level and cost, it also causes that the LED lamp with multiple lighting crystalline grains has much higher complexity in procedures comparing with that of the LED lamp with single lighting crystalline grain. Therefore, these kinds of two-lamps typed lamp bodies really are not very ideal, and needs to be improved.

SUMMARY OF THE INVENTION

The present invention is to provide a lamp structure improvement in the two-lamps typed decoration lamp string, whose characteristics are that each lamp body of the said lamp string is composed of a single soft head, a single soft core and, a LED single body of the ordinary half-shaped type separately package-covered with a single lighting crystalline grain. Through this, its object is to lower the manufacturing cost of lamp body in the two-lamps typed decoration lamp string. By cooperating with the drawings, the characteristics and effectiveness of the present invention now will be described as following.

DETAILED DESCRIPTION OF THE PREFERRED EMBODIMENTS

Figure 1:
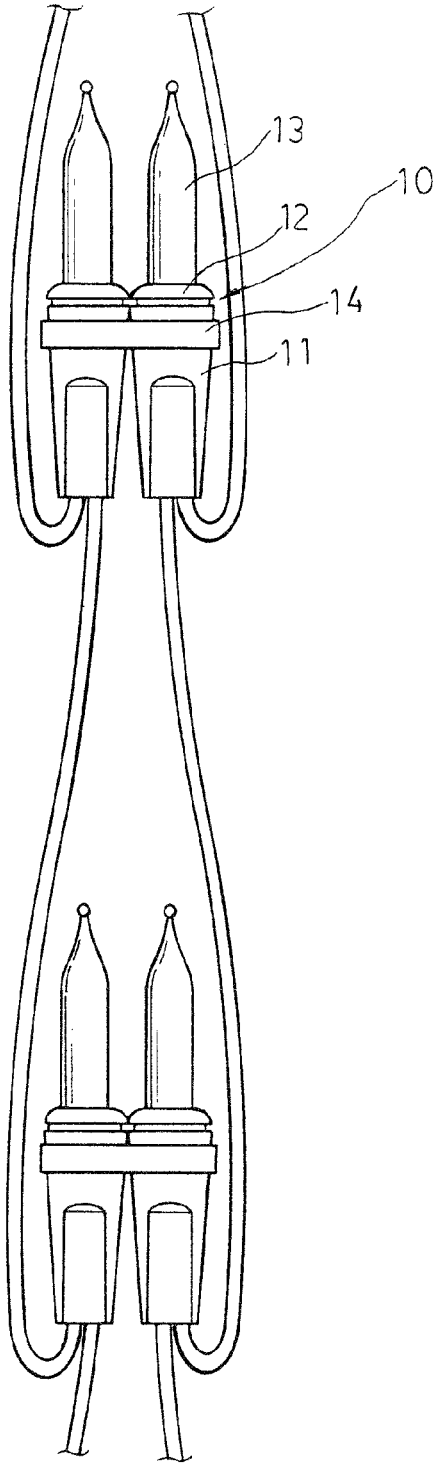
FIG. 1 (prior art)
FIGS. 1 to 3 are structural diagrams of lamp bodies in the known decoration lamp strings.
Figure 2:
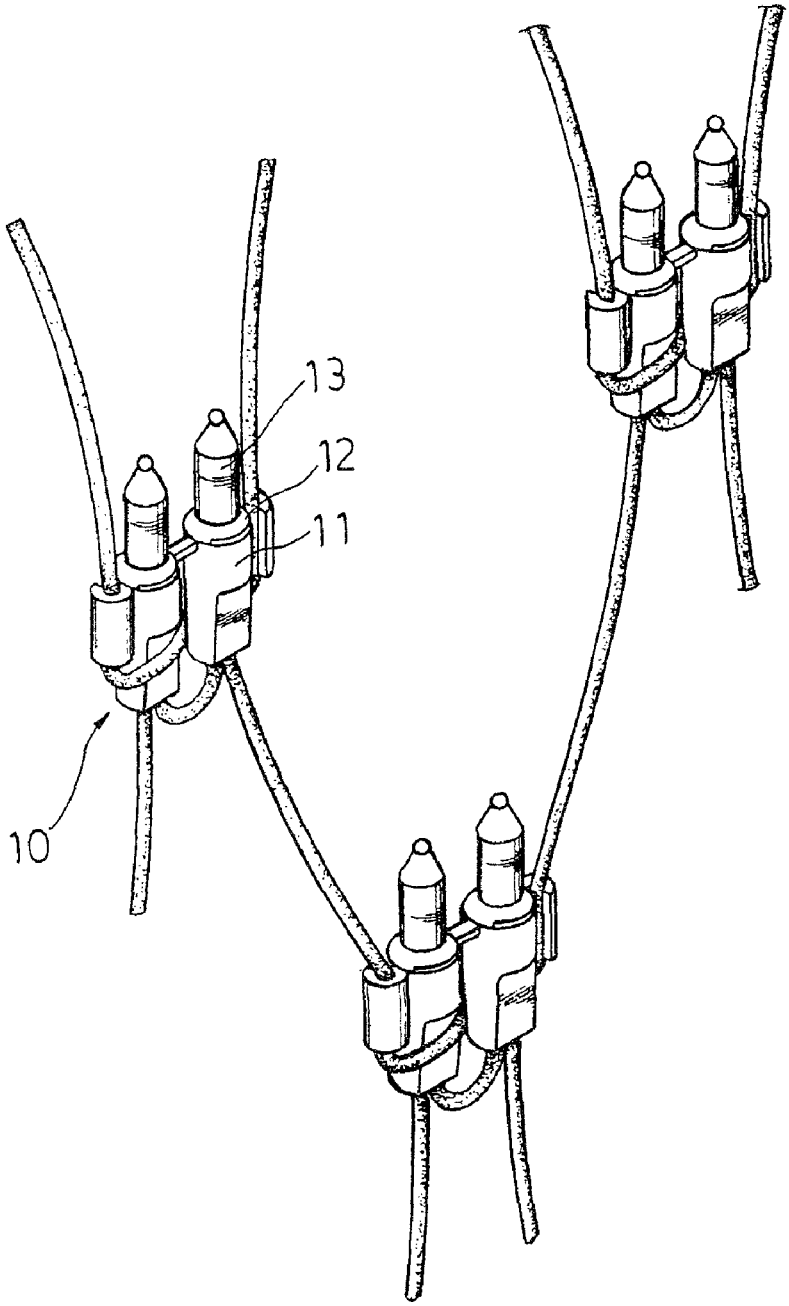
FIG. 2 (prior art)
Figure 3:
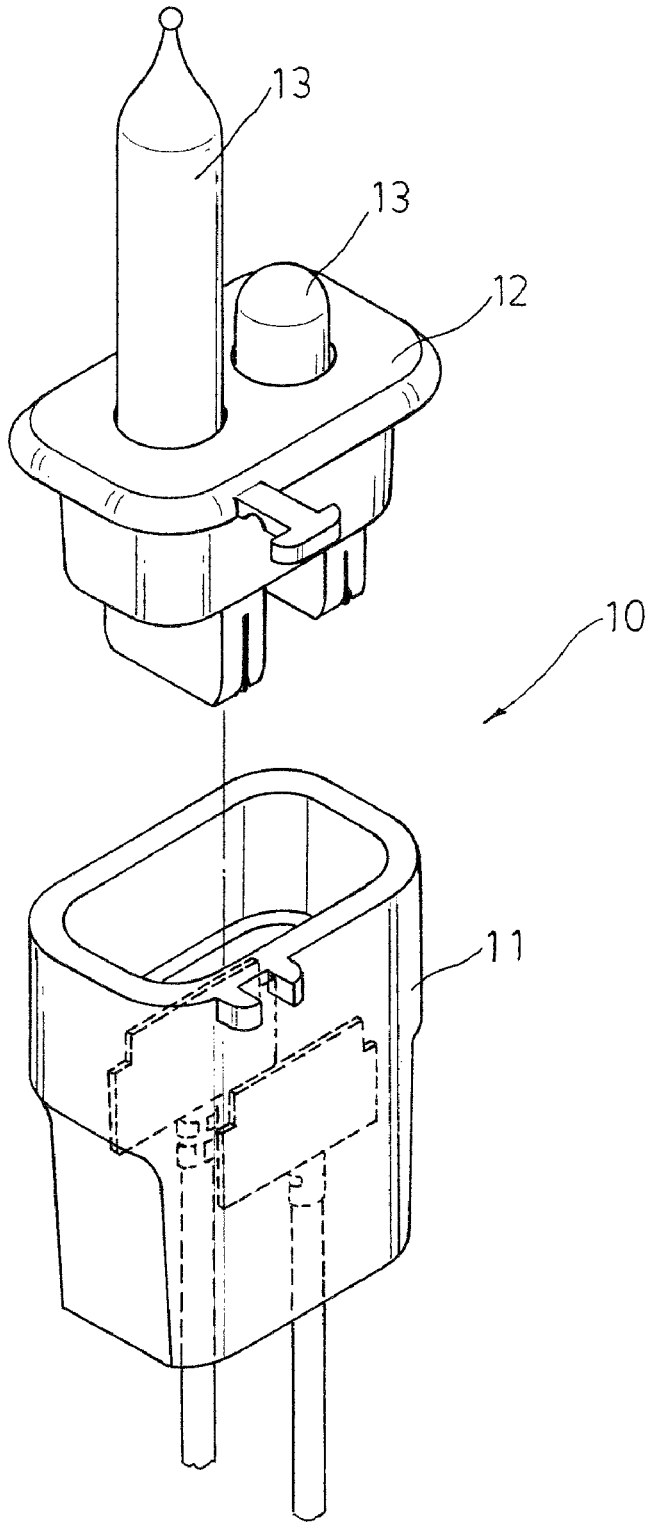
FIG. 3 (prior art)
Figure 4:
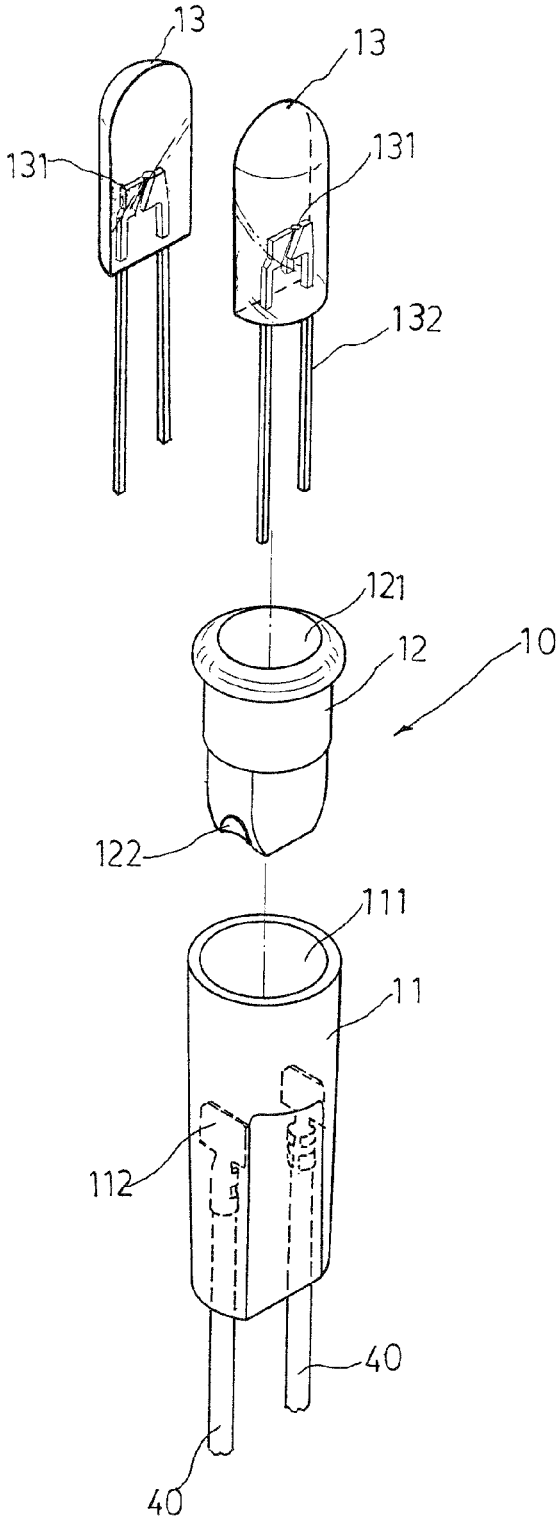
FIGS. 4 to 5 are structural diagrams of lamp bodies in the decoration lamp strings of present invention.
Figure 5:
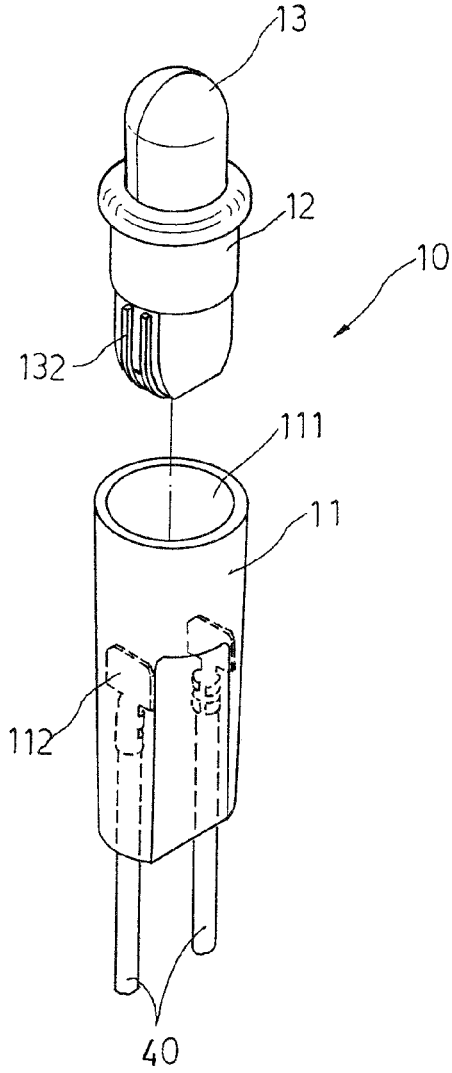

The present invention is a lamp structure improvement in the two-lamps typed decoration lamp string, as shown in FIG. 4. Each lamp body 10 of said lamp string is composed of a single soft head 11, a single soft core 12, and a single amp 13, wherein the lamp 13 is a LED with the LED single body of half-shaped type separately package-covered with a single lighting crystalline grain 131 then leaned against each other to form an ordinary shape-and-sized single piece such that the LED with ordinary single shape-and-sized piece forms a shape with two lighting crystalline grains 131 and four connecting pins 132. The soft head 11 is set with a connect-fit groove 111 for insert-laying the soft core 12. And, the coppers 112 connect-fit with power conducting wires 40 are set in left-right two sides of connect-fit groove 111. The soft core 12 is set with a housing groove 121 for insert-laying the lamp 13. And, four penetrating holes 122 are set on the bottom of soft core 12 for penetrate-laying the LED connecting pins 132. Through these, the lamp 13 formed by LED is insert-laid in the housing groove 121 of soft core 12. After separately bending the LED connecting pins 132 against two sides of soft core 12, the soft core 12 is then insert-laid in the connect-fit groove 111 of soft head 11 and let the connecting pins 132 of LED touch against the coppers 112 in the soft head 11. The assembly of lamp body in a two-lamps typed decoration lamp string is then completed. And, due to the lamp 13 is a LED with the single body of half-shaped type separately package-covered with a single lighting crystalline grain 131 then leaned against each other to form an ordinary shape-and-sized single piece and with two lighting crystalline grains 131, the soft head 11 and soft core 12 of said two-lamps typed decoration lamp string thus also require only the size capable of housing an ordinary single sized LED.

Although the lamp body of present invention is called as two-lamps type, it can also be a multiple-lamps lamp body design with more than 3 or 4 lamps. And, each lamp source can be the forms with different lighting colors. That is, the present invention can use two (or multiple) pieces of this LED single bodies with half (or one third ⅓) shaped type separately package-covered with a single lighting crystalline grain then leaned against each other to form an ordinary shape-and-sized single-pieced LED as its lamp. And, the soft head and soft core require only the size capable of housing an ordinary single sized LED. It thus can achieve the expected object of lowering the manufacturing cost of two-lamps (or multiple-lamps) typed decoration lamp string.

Therefore, the present invention obviously is equipped with the conditions of patent act. And it is to be understood that any modified design according to the merit of the present invention will be still claimed in this application.

I claim:

1. A lamp structure of two-lamp type decoration lamp string, wherein each lamp body of said lamp string comprises a single soft head, a single soft core and a single lamp, the soft head forming a groove for receiving the soft core therein, coppers electrically connected with power conducting wires being set in the groove at opposite left and right sides, the soft core forming a housing groove for receiving the lamp therein, the soft core having a bottom through which penetrating holes are formed, the improvements comprising:

the lamp being an LED comprising two half-shaped bodies, each of which is individually packaged with a single lighting crystalline grain, the bodies being leaned against each other to form combined configuration of ordinary shape and size, such that the LED with a combined configuration of ordinary shape and size forms a structure comprising two lighting crystalline grains each having connecting pins.

2. The lamp of two-lamp type decoration lamp string according to claim 1, wherein the lamp comprises a multiple-lamp structure comprising more than 3 or 4 lamps.

3. The lamp structure of two-lamp type decoration lamp string according to claim 1, wherein the lamp comprises different light colors.

* * * * *